United States Patent [19]

Stevens et al.

[11] Patent Number: 4,577,575

[45] Date of Patent: Mar. 25, 1986

[54] FOUR-STEP BUTTONHOLE MECHANISM FOR SEWING MACHINES

[75] Inventors: Victor G. Stevens, Westfield; Pao-Ter Huang, Edison, both of N.J.

[73] Assignee: The Singer Company, Stamford, Conn.

[21] Appl. No.: 778,654

[22] Filed: Sep. 23, 1985

[51] Int. Cl.[4] ..... D05B 3/06

[52] U.S. Cl. ..... 112/449

[58] Field of Search ..... 112/449

[56] References Cited

U.S. PATENT DOCUMENTS 3,316,868 5/1967 Eguchi .
3,460,496 8/1969 Meier ..... 112/449
3,636,900 1/1972 Rogers et al. .
4,216,731 8/1980 Yazawa ..... 112/449 X
4,413,576 11/1983 Taguchi ..... 112/449

*Primary Examiner*—Werner H. Schroeder
*Assistant Examiner*—Andrew M. Falik
*Attorney, Agent, or Firm*—Robert E. Smith; David L. Davis; Edward L. Bell

[57] ABSTRACT

A sewing machine buttonholing mechanism is disclosed wherein feed balance between buttonhole side stitches is attained by positioning of buttonholing cam means rather than by the balance control of the driven cam controlled feed mechanism, and zero feed during bar tacking is independently set and uninfluenced by side stitch equalization.

4 Claims, 5 Drawing Figures

FOUR-STEP BUTTONHOLE MECHANISM FOR SEWING MACHINES

BACKGROUND OF THE INVENTION

This invention relates to sewing machines of the type employing pattern cam influenced mechanism for sewing stitch patterns in which not only the bight, i.e., the jogging of the needle laterally of the direction of work feed, is varied, but also the magnitude and direction of work feed may be cam influenced. More particularly, this invention pertains to a sewing machine of the above character which includes a four-step buttonhole mechanism, that is, operator influenced selection means for succesively setting the sewing machine controls to produce the four parts of a straight buttonhole, which include the bar tack at one end, zigzag stitches along one side in one direction of feed, the bar tack at the other end, and zigzag stitches along the other side in the opposite direction of feed.

A problem arises with sewing machines having both pattern cam control mechanism for the work feed and four-step buttonhole mechanism in providing for compatible adjustments of tolerance variations in each of these mechanism.

Because sewing machine work feed mechanisms may be more effective in feeding certain work fabrics in one direction than in the other, feed balancing adjustments are known for shifting the position of zero feed within the range of feed control, thus purposely to favor work feed in one direction so as to equalize the effectiveness of the work feeding mechanism in both directions of feed. For the buttonhole mechanism, however, known feed cam balancing means are not satisfactory for two reasons. For one reason, in buttonhole formation not only is equalization of the work feed in each direction of feed necessary, but it is also a requirement for quality buttonhole appearance that the work feed be maintained at zero during bar tack formation at each end of the buttonhole and, therefore, the shift of the position of zero feed incident to known feed balance control adjustment is detrimental to bar track formation when buttonholing. For the second reason, feed balance controls for required sensitivity are typically limited as to total possible adjustment which may be insufficient to reconcile the tolerance accumulation in a four-step buttonhole mechanism.

SUMMARY OF THE INVENTION

It is an object of this invention to provide a regulator effective to maintain zero feed during the bar tack formation steps of a four-step buttonhle mechanism which regulator is separate from and compatible with feed pattern cam balancing means.

This object of the invention is attained by providing for cooperation with the sewing machine feed cam follower which is effective during buttonhole bar tack formation, a cam means which is stationary during machine operation but which, under operator influence, is shiftably supported so that work feed during bar tack formation may be maintained at zero in any desired setting of the feed balance control.

It is also an object of this invention to provide in a four-step buttonhole mechanism means for equalizing the effectiveness of the sewing machine work feeding mechanism during formation of buttonhole side stitches in forward and reverse directions of feed without disturbing the zero feed condition of the work feeding mechanism during formation of the bar tacks at each end of the buttonhole.

This object of the invention is attained by providing for cooperation with the sewing machine feed cam follower which is effective during buttonhole side stitch formation in one direction of work feed, a cam means fixed to the bar tack feed cam means and shiftably supported for repositioning therewith so as to maintain a constant differential between the work feed during bar tacking and during said one direction of work feed, and by providing for cooperation with the sewing machine feed cam follower which is effective during buttonhole side stitching in the opposite direction of work feed, a cam means which is stationary during machine operation but which is shiftably supported independently of the bar tack feed cam means to permit equalization of the forward and reverse direction work feeds.

DESCRIPTION OF THE PREFERRED EMBODIMENT

Figure 1:
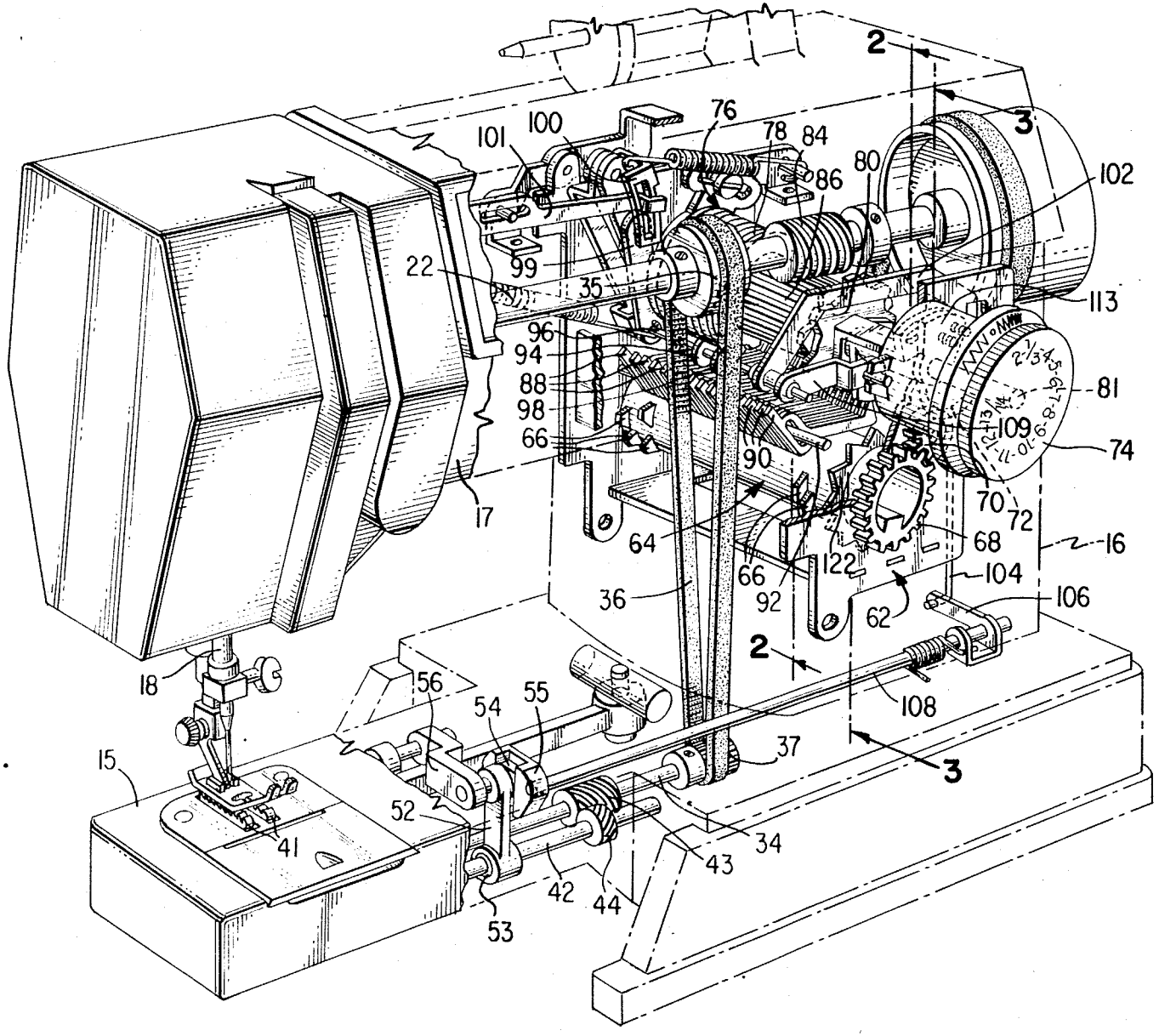
FIG. 1 is a perspective view of a sewing machine with portions of the machine frame broken away and shown in phantom lines to expose mechanism therein embodying this invention.
Figure 2:
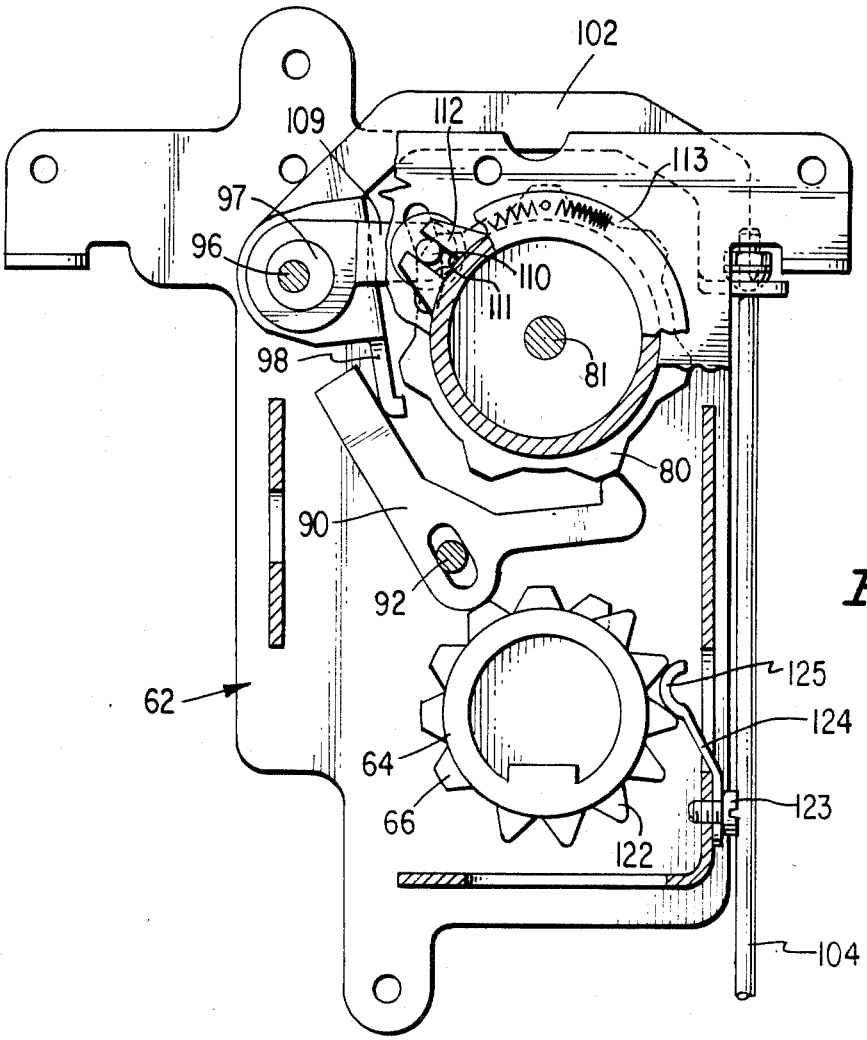
FIG. 2 is an enlarged cross sectional view taken substantially along line 2—2 of FIG. 1 showing the feed pattern cam mechanism and the feed balancing mechanism.

The sewing machine illustrated in FIG. 1 to which this invention is applied may be of the type disclosed in the U.S. Pat. application of R. B. Brauch and J. Mihovch, Ser. No. 646,890, filed Sept. 4, 1984, U.S. Pat. No. 4,553,491 which is incorporated hereby by reference. The general organization of parts in the sewing machine and the stitch forming instrumentalities thereof may be as disclosed in the above referenced patent application including a bed 15, a standard 16 rising from the bed, and a bracket arm 17 overhanging the bed. A needle bar 18 is supported in the bracket arm for endwise reciprocation in response to rotation of an arm shaft 22. A bed shaft 34 is rotatable by the arm shaft 22 acting through a sprocket 35 on the arm shaft, a timing belt 36 and a sprocket 37 on the bed shaft. A looptaker, not shown, is rotatable in timed relation to endwise reciprocation of needle 32 by the bed shaft.

The machine includes mechanism of a well known type for imparting work transporting movement to a feed dog. 41. Such mechanism includes a feed drive shaft 42 driven by gears 43 and 44 from the bed shaft. A pitman 52 driven by an eccentric 53 on shaft 42 is connected to reciprocate a slide block 54 in a slotted guide member 55 and a link 56 pivotally connects the pitman 52 with the feed dog 41. The magnitude and direction of work feeding movements of feed dog 41 are determined by the inclination of the guide member 55.

Reference character 62 designates the frame of a module wherein mechanism for controlling pattern and buttonhole sewing is located. Such control mechanism includes a cam selecting rotatable drum 64 with radially projecting fingers 66 that are spaced apart from one another both longitudinally and circumferentially on the drum. The drum includes a gear 68 which is engaged by an idler gear 70. The idler gear meshes with a gear 72 which is rotatable by a dial 74. Drum 64 may, therefore, be rotationally positioned by operation of the dial.

The control mechanism also includes a drum 76 with needle bight controlling cams 78 as well as feed controlling cams 80 thereon. Drum 76 is rotatably supported on a fixed shaft 81 for continuous rotation by arm shaft 22 acting through a worm 84 on the arm shaft and a gear 86 on the drum. Cam followers 88 and 90, pivotally mounted on a fixed shaft 92, are selectively positionable by fingers 66 on cam selecting drum 64 against the needle bight and feed controlling cams 78 and 80, respectively, on drum 76. Cam followers 88 are associated with an actuator 94 pivoted on a fixed shaft 96, and cam followers 90 are associated with an actuator 98 which is pivoted on a bushing 97 journaled eccentrically on the shaft 96. Whenever a cam follower is positioned by a finger 66 on selecting drum 64 against a cam on drum 76, such cam follower is also caused to engage its associated actuator 94 or 98, and the actuator is moved by the cam follower according to the profile of the cam during rotation of drum 76. Actuator 94 connects through an arm 99 thereon, a link 100, and a link 101 with a gate (not shown) to control a lateral movement of the needle, whereas actuator 98 connects through links 102, 104 and 106 with a rock shaft 108 to which the slotted guide member 55 is affixed thereby to control work feeding movements of feed dog 41.

The eccentric bousing 97 provides for a balance adjustment whereby the work feed in forward and in reverse directions under the influence of feed pattern cams 80 may be made equal by slightly shifting the relationship between the cam follower position and the position of the guide member 55 in which zero feed is attained thus favoring one direction of work feeding or the other depending upon the peculiarities of the work fabric or the linkage to the feed dog. For adjusting the angular position of the bushing 97, a rock arm 109 secured to the bushing carries a lateral pin 110 embraced by a radial slot 111 formed in a projection 112 from a balance adjusting dial 113 journaled coaxially on the selector dial 74.

A bidirectional ratchet wheel 122 on drum 64, and a detent spring 124 having one end secured by a screw 123 in frame 62 and the other end 125 in engagement with the ratchet wheel indexes drum 64 into cam selecting positions corresponding to positions of alignment of indicia 1 to 14 on the dial 74 with a reference mark (not shown) on the standard 16. In each of the positions of alignment of dial indicia 5 through 10 with the reference mark, drum 64 is disposed to select a particular cam 78 for the sewing of a bight controlled pattern defined thereby, whereas in each of the positions of alignment of dial indications 11 through 14 with the reference mark, both a particular needle jogging cam 78 and a particular feed pattern cam 80 are selected for the sewing of a bight and feed controlled pattern.

The positions of dial 74 with indicia 2, $\frac{1}{3}$, and 4 aligned with the reference mark provide for the various stitch configurations which together define a buttonhole. This type of buttonhole mechanism is referred to as a four-step buttonhole mechanism since four settings of the dial 74 are required in sequence in order to form the four parts of a buttonhole, i.e., the bars at each end and the opposite side stitches. In the various buttonhole positions of the dial 74, specific needle jogging cams in the cam group 78 are selected by appropriate cam selecting fingers 66 on the drum 64 but the feed controlling pattern cams 80 are not utilized. Instead, three spaced feed controlling cam surfaces 130, 131 and 132 are provided on members which are fixed with respect to the sewing machine frame. This invention is concerned with the manner in which these cam surfaces 130, 131 and 132 are related to each other and to the pattern cam mechanism of the sewing machine.

Figure 3:
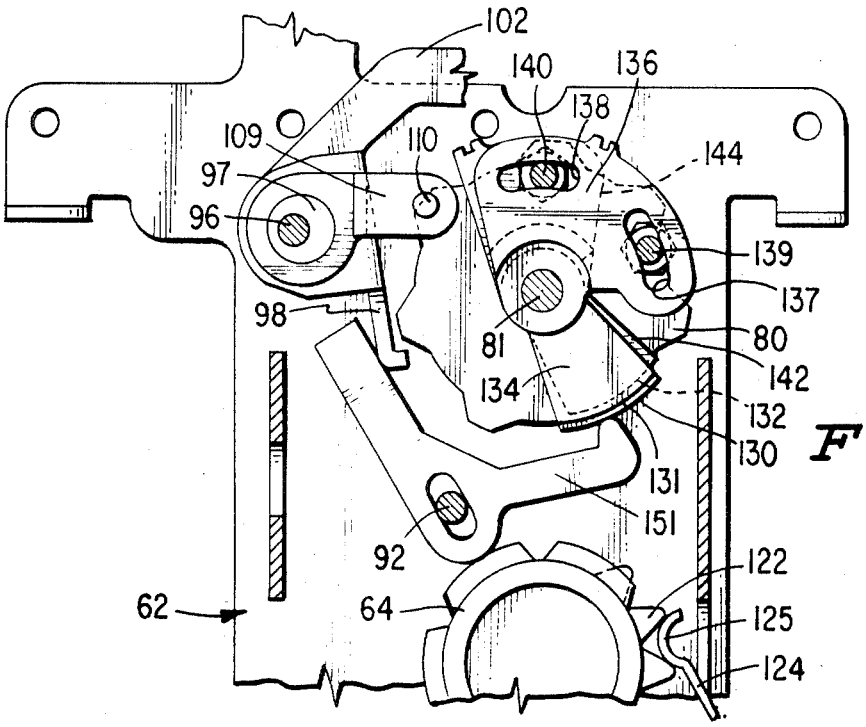
FIG. 3 is an enlarged cross sectional view taken substantially along line 3—3 of FIG. 1 showing the four-step buttonhole mechanism of this invention.
Figure 4:
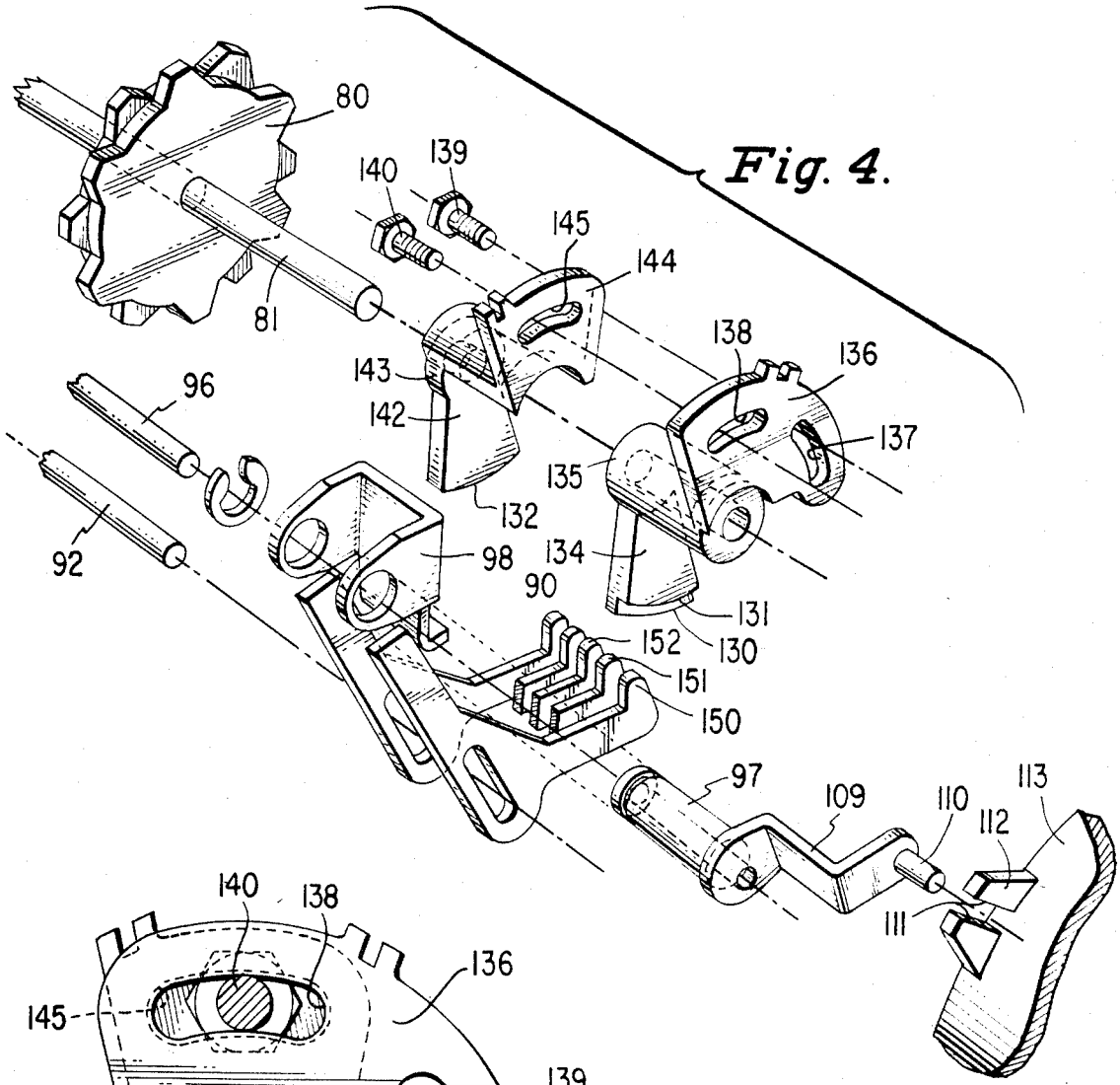
FIG. 4 is a disassembled perspective view of critical elements of both the feed pattern cam and four-step buttonhole mechanisms of this invention.
Figure 5:
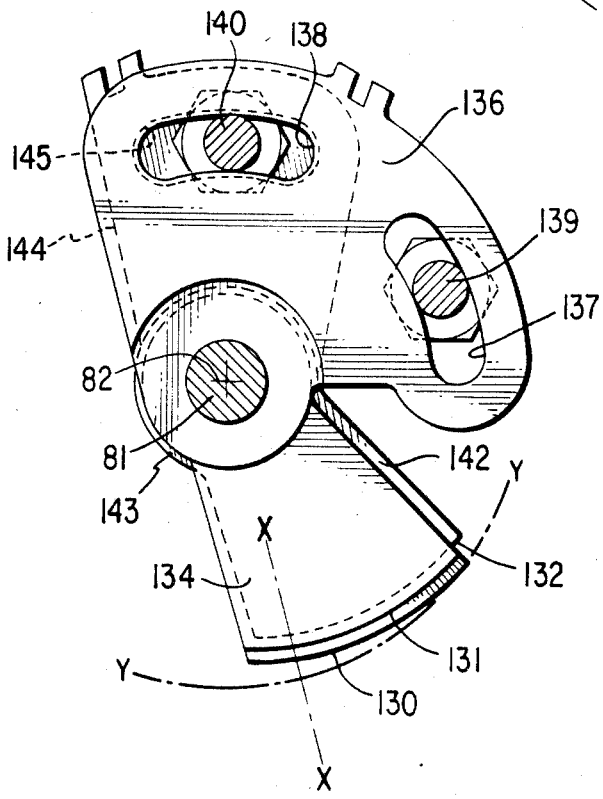
FIG. 5 is an enlarged elevational view of the four-step buttonhole influencing cams of this invention.

As best shown in FIGS. 3, 4 and 5, buttonholing feed cam surfaces 103 and 131 are both formed on a single radial arm 134 projecting from a hub 135 arranged on and angularly adjustable about the shaft 81 on which the pattern cams 88 and 90 are rotatable. A sector 136 extending from the hub 134 is formed with sector slots 137 and 138 accommodating fastening screws 139 and 140 by which the radial arm 134 may be secured to the sewing machine frame in selected angular position about the shaft 81. The cam surface 132 is formed on a radial arm 142 projecting from a hub 143 arranged on and angularly adjustable about the shaft 81 separately from the radial arm 134. A sector 144 extending from the hub 143 is formed with a sector slot 145 accommodating the fastening screw 140 by which the radial arm 142 may be secured to the sewing machine frame in selected angular position about the shaft 81.

With reference to FIG. 4, three cam followers 150, 151 and 152 are arranged on the same shaft 92 on which the followers for needle jogging cams 88 and feed pattern cams 90 are carried. The cam followers 150, 151 and 152 are arranged opposing fixed buttonholing feed cam surfaces 130, 131 and 132, respectively, and each is disposed to track the respective buttonholing cam surfaces along a line X-X shown in FIG. 5, and to cooperate with the actuator 98 in influencing the work feed.

FIG. 5 also illustrates that each of the buttonholing cams surfaces 130, 131 and 132 describes an arc, the center of which is displaced from the axis 82 of the shaft 81. In FIG. 5, Y-Y indicates an arc, the center of which coincides with the axis 82 of shaft 81 and a comparison of the arc Y-Y with cam surfaces 130, 131 and 132 will indicate the manner in which angular adjustment of the radial arms 134 and 142 can alter the influence of cam surfaces 130, 131 and 132 on the respective can followers 150, 151 and 152.

Buttonholing cam surface 131 is tracked by cam follower 151 when the dial 74 is turned to position indicia $\frac{1}{3}$ in alignment with the reference mark on the machine frame. In this position of dial 74, a needle jogging cam 78 for producing a wide bight zigzag stitch is also activated so that the bar at either end of a buttonhole will be produced. In order that the work feed will be reduced to zero during bar formation, the radial arm 134 may be angularly adjusted perfectly to set the feed at zero preferably at a predetermined setting of the balance control dial, as for instance, in the mid position of the balance control dial.

The cam surface 130 which is tracked by the cam follower 150 influences the work feed in the forward direction when the dial 74 is set with indicia 2 aligned with the reference mark. In this setting of dial 74, a narrow needle jog pattern cam is also selected and, since the feed cam surface 130 is everywhere equidistant from that of 131, the same increment of feed will result regardless of the position of adjustment of the radial arm 134.

In the dial 74 position with indicia 4 opposite the reference mark, buttonholing cam surface 132 will be tracked by cam follower 152 providing for feed in the reverse direction. Such reverse feeding can be made equal to that in the forward direction influenced by cam surface 130 by angular adjustment of the radial arm 142 to balance the feed increment on the opposite legs of the buttonhole. Such feed balancing during buttonhole sewing with the present invention in no way influences or disturbs the zero feed setting of the cam surface 131 which is effective during bar tack formation.

We claim:

1. In a sewing machine having reversible work feeding mechanism, driven work feed pattern cam means, cam follower mechanism, operative connections between said cam follower mechanism and said work feeding mechanism including an operator influenced balance control for shifting the location of zero work feed within a range of cam follower mechanism movements, a four-step buttonhole mechanism including three work feed controlling cam means cooperable with said cam follower mechanism, a first of said buttonholing cam means for influencing zero work feed during bar tacking at each end of a buttonhole, the other two of said buttonholing cam means for influencing work feeding in opposite directions during stitching along opposite sides of a buttonhole, means securing said buttonholing cam means stationary on said sewing machine during buttonhole stitching, and operator influenced means for selectively varying the stationary position of said first of said buttonholing cam means so that it will influence zero work feed in any selected setting of said balance control.

2. A sewing machine as set forth in claim 1 in which one of said other buttonholing cam means is fixed with respect to said first of said buttonholing cams means and arranged to influence an unalterable difference in work feeding magnitude from that influenced by said first buttonholing cam means, and operator influenced means for shifting the stationary position of the remaining other buttonholing cam means so that it will influence work feed equal in magnitude and opposite in direction to that influenced by said other buttonholing cam means fixed with respect to said first buttonholing cam means.

3. A sewing machine as set forth in claim 1 in which said driven work feed pattern cam means comprise pattern cam discs rotatable about the axis of a cam shaft in said sewing machine, in which said buttonholing cam means is journaled on said cam shaft, in which said first of said buttonholing cam means includes an arcuate cam follower engaging surface arranged eccentric to said cam shaft axis, and in which said operator influenced means for selectively varying the stationary position of said first buttonholing cam means comprises clamp means for securing said first buttonholing cam means in selected angular position about said cam shaft.

4. A sewing machine as set forth in claim 3 in which the other of said buttonholing cam means each includes arcuate cam follower engaging surfaces arranged eccentric to said cam shaft axis, in which one of the other of said buttonholing cam means is fixed with respect to said first buttonholing cam means with the centers of said arcuate cam follower engaging surfaces coincident with each other, and in which operator influenced clamp means is provided for selectively varying the angular position of the remaining other buttonholing cam means about said cam shaft.

* * * * *